US005758577A

United States Patent [19]

Ebina

[11] Patent Number: 5,758,577

[45] Date of Patent: Jun. 2, 1998

[54] CYLINDER CLEANING APPARATUS FOR PRINTING PRESS

[75] Inventor: Toshihiko Ebina, Ibaragi, Japan

[73] Assignee: Komori Corporation, Japan

[21] Appl. No.: 683,713

[22] Filed: Jul. 18, 1996

[30] Foreign Application Priority Data

Jul. 26, 1995 [JP] Japan ..... 7-190202

[51] Int. Cl.[6] ..... B41F 35/00

[52] U.S. Cl. ..... 101/423; 101/425

[58] Field of Search ..... 101/423, 424, 101/425; 15/256.52, 256.51

[56] References Cited

U.S. PATENT DOCUMENTS

| | | | |
|---|---|---|---|
| 3,084,626 | 4/1963 | Stobb | 101/425 |
| 4,555,989 | 12/1985 | Marass et al. | 101/424 |
| 4,986,182 | 1/1991 | Sawaguchi et al. | 101/425 |
| 5,105,740 | 4/1992 | Loos et al. | 101/424 |
| 5,117,754 | 6/1992 | Nozaka et al. | 101/425 |
| 5,325,779 | 7/1994 | Ebina | 101/423 |
| 5,325,780 | 7/1994 | Matsuda et al. | 101/424 |
| 5,328,116 | 7/1994 | Hishinuma | 242/543 |

FOREIGN PATENT DOCUMENTS

| | | | |
|---|---|---|---|
| 0364901 | 4/1990 | European Pat. Off. | 101/425 |
| 1314173 | 12/1992 | Japan . | |
| 6-67031 | 9/1994 | Japan . | |

*Primary Examiner*—Edgar S. Burr
*Assistant Examiner*—Anthony H. Nguyen
*Attorney, Agent, or Firm*—Blakely Sokoloff Taylor & Zafman

[57] ABSTRACT

A cylinder cleaning apparatus for a printing press includes a cleaning web take-up roll, a constant amount feed mechanism, a unit throw-on/throw-off actuator and an actuator, and a plate and bolts. The cleaning web take-up roll takes up a cleaning web supplied from a cleaning web supply roll to clean a circumferential surface of a cylinder. The constant amount feed mechanism takes up a constant amount of the cleaning web on the take-up roll regardless of an amount of the cleaning web taken up by the take-up roll. The unit throw-on/throw-off actuator and the actuator drive to rotate the take-up roll in taking up the cleaning web. The plate and bolts adjust a pivot amount of the take-up roll on which the constant amount of the cleaning web is taken up by the constant amount feed mechanism.

19 Claims, 14 Drawing Sheets

CYLINDER CLEANING APPARATUS FOR PRINTING PRESS

BACKGROUND OF THE INVENTION

The present invention relates to a cylinder cleaning apparatus for various types of printing presses, which cleans the circumferential surfaces of printing cylinders, e.g., a plate cylinder, a blanket cylinder, an impression cylinder, and a transfer cylinder, and rollers, e.g., a form roller and a vibrating roller.

Various types of printing presses, e.g., an offset printing press and an intaglio printing press, have printing cylinders, e.g., a plate cylinder, a blanket cylinder, an impression cylinder, and a transfer cylinder, and rollers, e.g., a form roller and a vibrating roller. During printing, foreign matters, e.g., ink dust and paper dust attach to the circumferential surfaces of these printing cylinders and rollers to degrade the quality of printed matter. Hence, the printing press is provided with a cylinder cleaning apparatus for removing these foreign matters. This cylinder cleaning apparatus is roughly constituted by a cleaning unit, a cleaning web take-up actuator, and a unit throw-on/throw-off actuator. The cleaning unit is provided with a supply roller and a take-up roller. The supply roller supplies a belt-like cleaning web made of an unwoven fabric or the like on which a cleaning liquid is supplied to wipe the foreign matters on the circumferential surfaces of the cylinders. The take-up roller takes up the cleaning web. The cleaning web take-up actuator drives to rotate the take-up roller so as to take-up the cleaning web. The unit throw-on/throw-off actuator moves the cleaning unit toward and away from the circumferential surfaces of the cylinders to cause the cleaning web to come into contact with or separate from the circumferential surfaces of the cylinder. The cylinder cleaning apparatus is provided with a constant amount feed mechanism for taking up a constant amount of cleaning web regardless of the amount of cleaning web taken up by the take-up roller.

FIGS. 18 and 19 show a conventional cylinder cleaning apparatus for a printing press. Referring to FIG. 18, a blanket cylinder 2 is axially supported between a pair of right and left frames 3. A unit throw-on/throw-off first actuator 4 has an actuating rod 5 capable of moving forward/backward and is pivotally mounted on the frames 3. A lever 6 has a proximal end pivotally mounted on the distal end of the actuating rod 5, a central portion swingably supported by a support shaft 7 extending from a sub-frame 10 to be described later, and a swing end formed with a U-shaped groove 8. The sub-frame 10 is attached to the corresponding frame 3 with a bolt 10*a*. A U-shaped groove 11 is formed in the upper portion of the sub-frame 10, and a cloth take-up second actuator 12 having an actuating rod 13 is attached to substantially the center of the sub-frame 10.

A cleaning unit entirely denoted by reference numeral 15 has a pair of right and left side frames 16 (one is not illustrated in FIG. 18). A cleaning cloth supply roll 18 is rotatably supported by the side frames 16. A cleaning cloth 17 serving as the cleaning web is wound on the cleaning cloth supply roll 18. As shown in FIG. 19, a cloth take-up shaft 19 is supported by the side frames 16 to be able to be rotated by a one-way clutch 20 only counterclockwise, thereby constituting a cleaning cloth take-up roll 21 for taking up the cleaning cloth 17. As shown in FIG. 19, a cloth take-up lever 22 is fixed to the cloth take-up shaft 19 through a one-way clutch 23 fitted on the cloth take-up shaft 19. When the cloth take-up lever 22 pivots counterclockwise, it integrally pivots the cloth take-up shaft 19; when it pivots clockwise, it pivots only the cloth take-up lever 22 without pivoting the cloth take-up shaft 19.

The cloth take-up lever 22 has one side portion formed with a projection 22*a*, and a pin 24 extends vertically on its upper portion. The cloth take-up lever 22 is biased by a tension spring 25 having one end hooked on the corresponding side frame 16 to pivot clockwise. An elastic plate 26 urges the cleaning cloth 17 extending between the cleaning cloth supply roll 18 and cleaning cloth take-up roll 21 against the circumferential surface of the blanket cylinder 2. A constant amount feed mechanism entirely denoted by reference numeral 27 is constituted by a support shaft 28, a constant amount feed cam 29, and an L-shaped roller arm 30. The support shaft 28 is rotatably supported by the side frame 16. The constant amount feed cam 29 is fixed to the support shaft 28. The roller arm 30 is fixed to the end portion of the support shaft 28 and has a distal end on which a roller 31 is pivotally mounted. A tension coil spring 32 extends between the constant amount feed cam 29 and the spring hook of the corresponding side frame 16. The tension coil spring 32 applies a pivot force to the roller arm 30 counterclockwise so as to constantly urge the roller 31 against the circumferential surface of the cleaning cloth supply roll 18.

The constant amount feed cam 29 engages with the projection 22*a* of the cloth take-up lever 22 to regulate the pivot end limit of the cloth take-up lever 22. When the constant amount feed cam 29 is pivoted by the movement of the roller 31 upon reduction of the weight of the cleaning cloth supply roll 18, the pivot end limit of the cloth take-up lever 22 changes, so that the cleaning cloth 17 is always taken up for a constant amount by the cleaning cloth take-up roll 21 upon one pivot movement of the cloth take-up lever 22. Pins 33 and 34 extend on the upper and lower portions, respectively, of the side frame 16. The upper pin 33 engages in the U-shaped groove 11 of the sub-frame 10, so that the cleaning unit 15 having the above arrangement is supported to be swingable about the pin 33 as the center of swing. The lower pin 34 engages in the U-shaped groove 8 of the lever 6, so that the cleaning unit 15 is biased by the lever 6 to swing.

The outline of the cleaning operation of the cylinder cleaning apparatus having the above arrangement will be described. A cleaning liquid is injected by an injection nozzle (not shown) toward the cleaning cloth 17. Then, the actuating rod 5 of the first actuator 4 is retracted and the lever 6 pivots clockwise in FIG. 18 about the support shaft 7 about the center of pivot. By this pivot movement, the cleaning unit 15 swings counterclockwise about the upper pin 33 as the center through the pin 34 engaging in the U-shaped groove 8 of the lever 6, to move to the cleaning position. Thus, the cleaning cloth 17 is urged against the circumferential surface of the blanket cylinder 2 rotating at a low speed to come into contact with it. Then, contamination attaching to the circumferential surface of the blanket cylinder 2 is wiped by the cleaning cloth 17 to which the cleaning liquid has been sprayed.

To take up the cleaning cloth 17 which is contaminated upon rotation of the blanket cylinder 2 through a predetermined amount, first, the first actuator 4 is actuated to move the rod 5 forward. Then, the cleaning unit 15 swings clockwise about the pin 33 as the center to separate the cleaning cloth 17 from the circumferential surface of the blanket cylinder 2. In this state, when the second actuator 12 actuates, the actuating rod 13 moves forward to engage with the pin 24. Thus, the cloth take-up lever 22 pivots counterclockwise to take up the cleaning cloth 17 on the cleaning cloth take-up roll 21. The amount of cleaning cloth 17 taken up at this time is always constant as the pivot end limit of the cloth take-up lever 22 is determined by the constant amount feed mechanism 27.

The cleaning operation of the blanket cylinder 2 and the take-up operation of the cleaning cloth 17 are repeated until the circumferential surface of the blanket cylinder 2 is cleaned completely.

Regarding the urging force that urges the cleaning cloth 17 against the circumferential surface of the blanket cylinder 2, an appropriate urging force is selected in accordance with the type of the cleaning cloth 17, and the contact width of the cleaning cloth 17 with respect to the blanket cylinder 2 in the rotating direction of the blanket cylinder 2 changes depending on the strength of the urging force. More specifically, when the urging force of the cleaning cloth 17 is large, the contact width becomes large; when it is small, the contact width becomes small. Thus, in the conventional cylinder cleaning apparatus for the printing press described above, when the urging force of the cleaning cloth 17 is large and the contact width of the cleaning cloth 17 with respect to the blanket cylinder 2 is large, the take-up amount of the contaminated cleaning cloth 17 becomes insufficient to sometimes cause defective cleaning. Inversely, when the urging force of the cleaning cloth 17 is small and the contact width of the cleaning cloth 17 and blanket cylinder 2 is small, the cleaning cloth 17 is taken up excessively, which is uneconomical.

SUMMARY OF THE INVENTION

It is an object of the present invention to provide a cylinder cleaning apparatus for a printing press in which defective cleaning is prevented.

It is another object of the present invention to provide a cylinder cleaning apparatus for a printing press which can use the cleaning web without waste.

In order to achieve the above objects, according to the present invention, there is provided a cylinder cleaning apparatus for a printing press, comprising a take-up roll for taking up a cleaning web supplied from a supply portion to clean a circumferential surface of a cylinder, a constant amount feed mechanism for taking up a constant amount of the cleaning web on the take-up roll regardless of an amount of the cleaning web taken up by the take-up roll, driving means for driving to rotate the take-up roll in taking up the cleaning web, and adjusting means for adjusting a pivot amount of the take-up roll on which the constant amount of the cleaning web is taken up by the constant amount feed mechanism.

DESCRIPTION OF THE PREFERRED EMBODIMENTS

The preferred embodiments of the present invention will be described with reference to the accompanying drawings.

Figure 1:
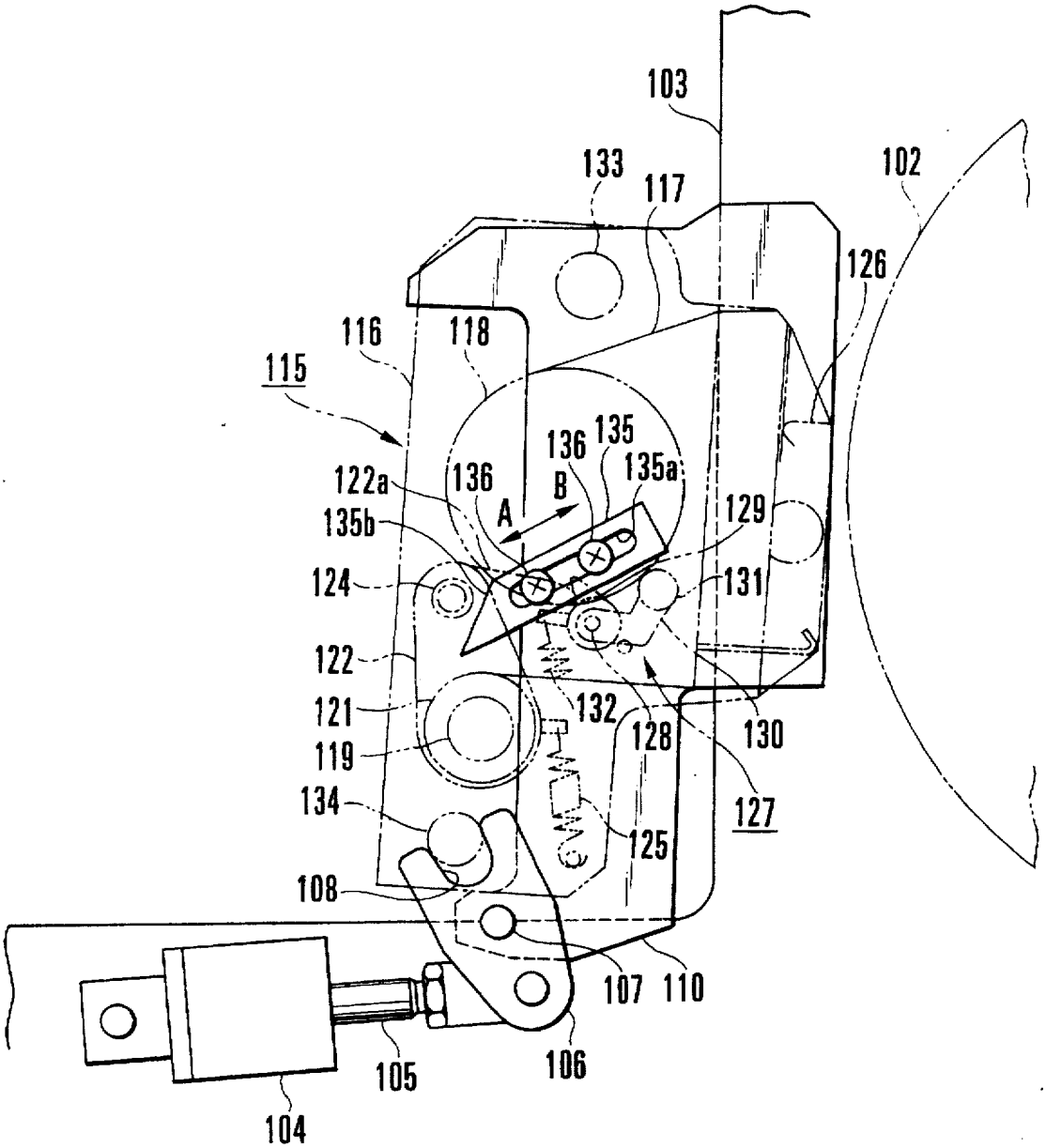
FIG. 1 is a side view of a cylinder cleaning apparatus for a printing press according to the first embodiment of the present invention.
Figure 2:
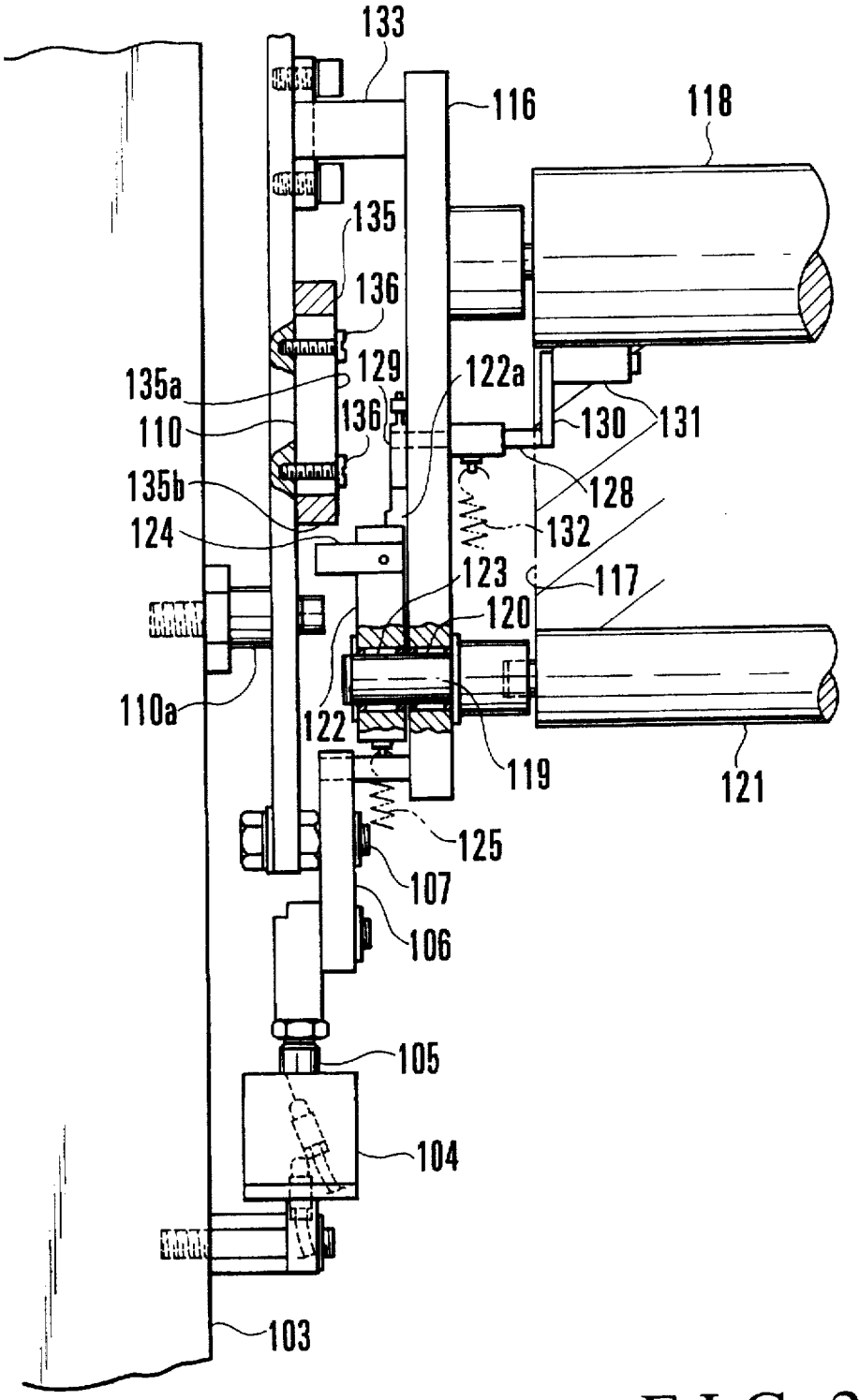
FIG. 2 is a partially sectional side view of the cylinder cleaning apparatus shown in FIG. 1.

FIGS. 1 and 2 show a cylinder cleaning apparatus for a printing press according to the first embodiment of the present invention. Referring to FIG. 1, a blanket cylinder 102 is axially supported between a pair of right and left frames 103. A unit throw-on/throw-off actuator 104 has an actuating rod 105 capable of moving forward/backward and is pivotally mounted on the frames 103. A lever 106 has a proximal end pivotally mounted on the distal end of the actuating rod 105, a central portion swingably supported by a support shaft 107 extending from a sub-frame 110 to be described later, and a swing end formed with a U-shaped groove 108. The sub-frame 110 is attached to the corresponding frame 103 with a bolt **110*a* shown in FIG. 2**.

A cleaning unit entirely denoted by reference numeral 115 has a pair of right and left side frames 116 (one is not illustrated in FIGS. 1 and 2). A cleaning cloth supply roll 118 is rotatably supported by the side frames 116. A cleaning cloth 117 serving as the cleaning web is wound on the cleaning cloth supply roll 118. A cloth take-up shaft 119 is supported by the side frame 116 to be able to be rotated by a one-way clutch 120 only counterclockwise, as shown in FIG. 2, thereby constituting a cleaning cloth take-up roll 121 for taking up the cleaning cloth 117. As shown in FIG. 2, a cloth take-up lever 122 is fixed to the cloth take-up shaft 119 through a one-way clutch 123 fitted on the cloth take-up shaft 119. When the cloth take-up lever 122 pivots counterclockwise, it integrally pivots the cloth take-up shaft 119; when it pivots clockwise, it pivots only the cloth take-up lever 122 without pivoting the cloth take-up shaft 119.

The cloth take-up lever 122 has one side portion formed with a projection 122*a*, and a pin 124 extends vertically on its upper portion. The cloth take-up lever 122 is biased by a tension spring 125 having one end hooked on the corresponding side frame 116 to pivot clockwise. An elastic plate 126 urges the cleaning cloth 117 extending between the cleaning cloth supply roll 118 and cleaning cloth take-up roll 121 against the circumferential surface of the blanket cylinder 102. A constant amount feed mechanism entirely denoted by reference numeral 127 is constituted by a support shaft 128, a constant amount feed cam 129, and an L-shaped roller arm 130. The support shaft 128 is rotatably supported by the side frame 116. The constant amount feed cam 129 is fixed to the support shaft 128. The roller arm 130 is fixed to the end portion of the support shaft 128 and has a distal end on which a roller 131 is pivotally mounted. A tension coil spring 132 extends between the constant amount feed cam 129 and the spring hook of the corresponding side frame 116. The tension coil spring 132 applies a pivot force to the roller arm 130 counterclockwise so as to constantly urge the roller 131 against the circumferential surface of the cleaning cloth supply roll 118.

The constant amount feed cam 129 engages with the projection 122*a* of the cloth take-up lever 122 to regulate the pivot end limit of the cloth take-up lever 122. When the constant amount feed cam 129 is pivoted by the movement of the roller 131 upon reduction of the weight of the cleaning cloth supply roll 118, the pivot end limit of the cloth take-up lever 122 changes, so that the cleaning cloth 117 is always taken up for a constant amount by the cleaning cloth take-up roll 121 upon one pivot movement of the cloth take-up lever 122. Pins 133 and 134 extend on the upper and lower portions, respectively, of the side frame 116. The cleaning unit 115 having the above arrangement is supported by the sub-frame 110 to be swingable about the upper pin 133 as the center of swing. The lower pin 134 engages in the U-shaped groove 108 of the lever 106, so that the cleaning unit 115 is biased by the lever 106 to swing. More specifically, the cleaning unit 115 is movable between a cleaning position (throw-on state) where it urges the cleaning cloth 117 against the circumferential surface of the blanket cylinder 102 and a retreat position (throw-off state) where it is separate from the blanket cylinder 102.

A plate 135 serves as an actuating member to pivot the take-up lever 122. The plate 135 is attached to the sub-frame 110 such that its abutting portion 135*b* having an oblique distal end can move toward and away from the pin 124. The plate 135 is formed into a substantially elongated parallelpiped, and an elongated mounting hole 135*a* is formed in the plate 135 in the longitudinal direction. The plate 135 is attached to the sub-frame 110 through two bolts 136 inserted in the mounting hole 135*a*. When the bolts 136 are loosened to move the plate 135 in directions A–B, the plate 135 can be moved toward and away from the pin 124.

The cleaning cloth take-up operation of the cylinder cleaning apparatus having the above arrangement will be described. During cleaning, when the blanket cylinder 102 rotates for a predetermined amount, it actuates the actuator 104 to move the actuating rod 105 forward, thereby swinging the cleaning unit 115 at the cleaning position clockwise about the pin 133 as the center of pivot. Thus, the cleaning unit 115 moves to the retreat position, and the cleaning cloth 117 is separated from the circumferential surface of the blanket cylinder 102, as shown in FIG. 1. At this time, the abutting portion 135*b* of the plate 135 is separate from the pin 124 of the cloth take-up lever 122 which has been restored to the initial position by the biasing force of the tension spring 125.

Figure 3:
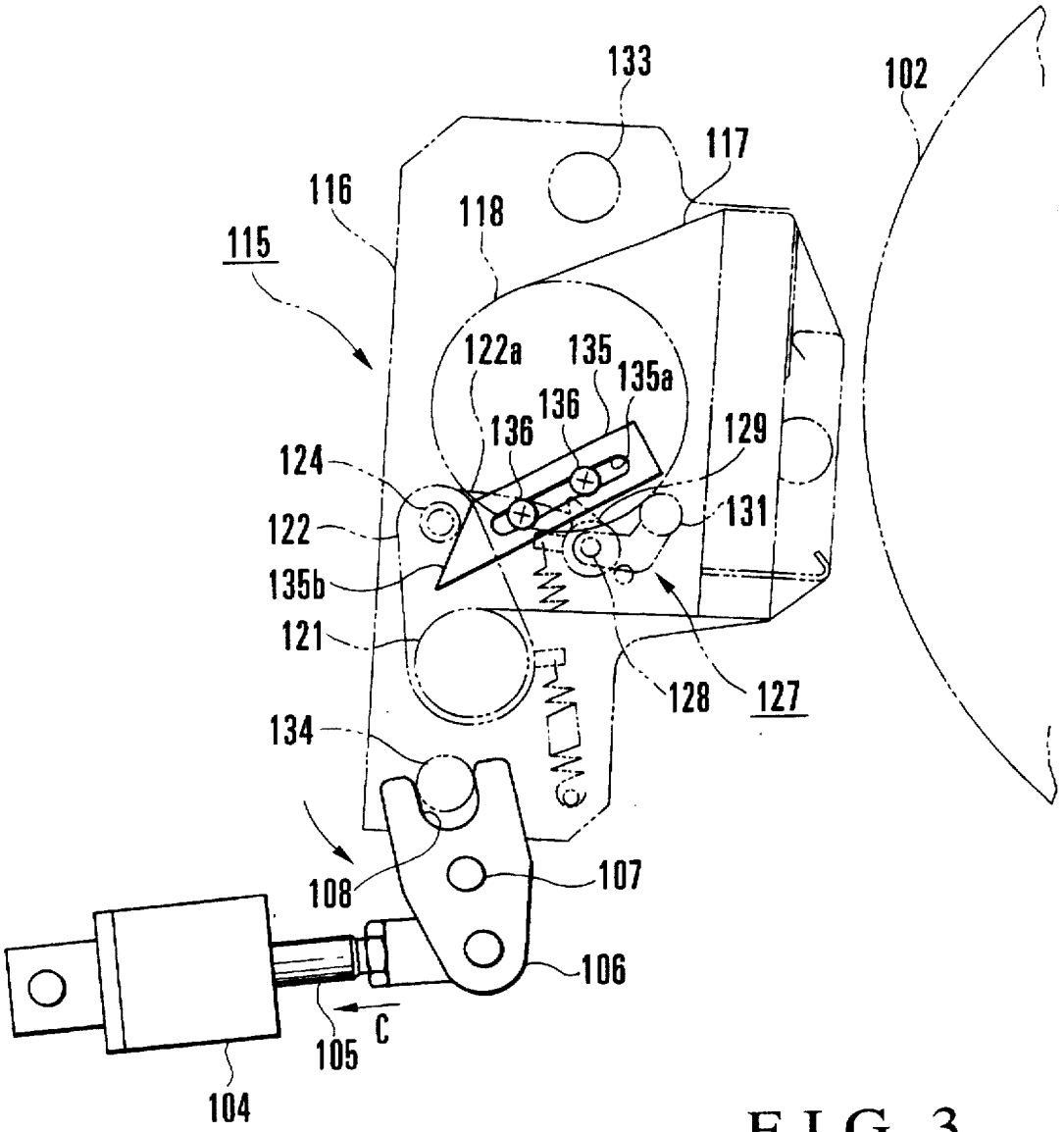
FIG. 3 is a side view for explaining the operation of the cylinder cleaning apparatus shown in FIG. 1.
Figure 4:
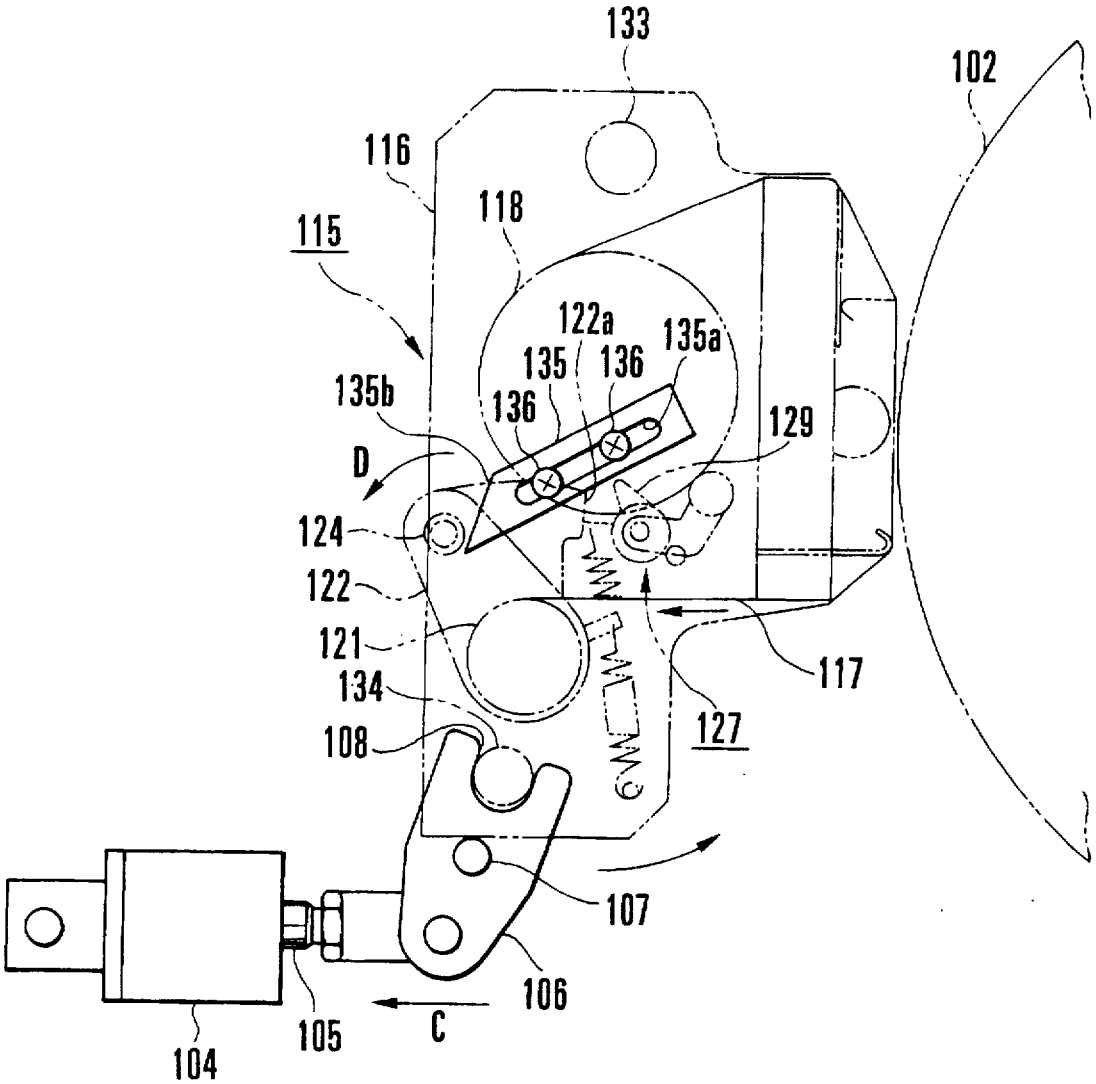
FIG. 4 is a side view for explaining the operation of the cylinder cleaning apparatus shown in FIG. 1.

Thereafter, as shown in FIG. 3, when the actuator 104 is actuated to move the actuating rod 105 backward in a direction C, the cleaning unit 115 swings counterclockwise about the pin 33 as the center. Thus, the pin 124 of the cloth take-up lever 122 abuts against the abutting portion 135*b* of the plate 135. When the actuating rod 105 is continuously moved backward in the direction C, the cleaning unit 115 further swings to the cleaning position, as shown in FIG. 4, to urge the cleaning cloth 117 against the circumferential surface of the blanket cylinder 102. At this time, since the plate 135 is fixed to the sub-frame 110, the cloth take-up lever 122 pivots in a direction D together with the pin 124 abutting against the abutting portion 135*b* of the plate 135, so that the cleaning cloth 117 is taken up by the cleaning cloth take-up roll 121.

To change the take-up amount of the cleaning cloth 117 in accordance with the types of the cleaning cloth 117 or the cleaning states, the bolts or screws 136 are loosened and the plate 135 is moved in the directions A-B shown in FIG. 1, so that the distance between the pin 124 and the abutting portion 135*b* is changed. More specifically, to reduce the take-up amount of the cleaning cloth 117, the plate 135 is moved in the direction B; to increase the take-up amount, the plate 135 is moved in the direction A. If calibration is formed in the plate 135 itself or near the plate 135, the moving amount of the plate 135 in the directions A-B can be determined accurately and quickly.

Figure 5:
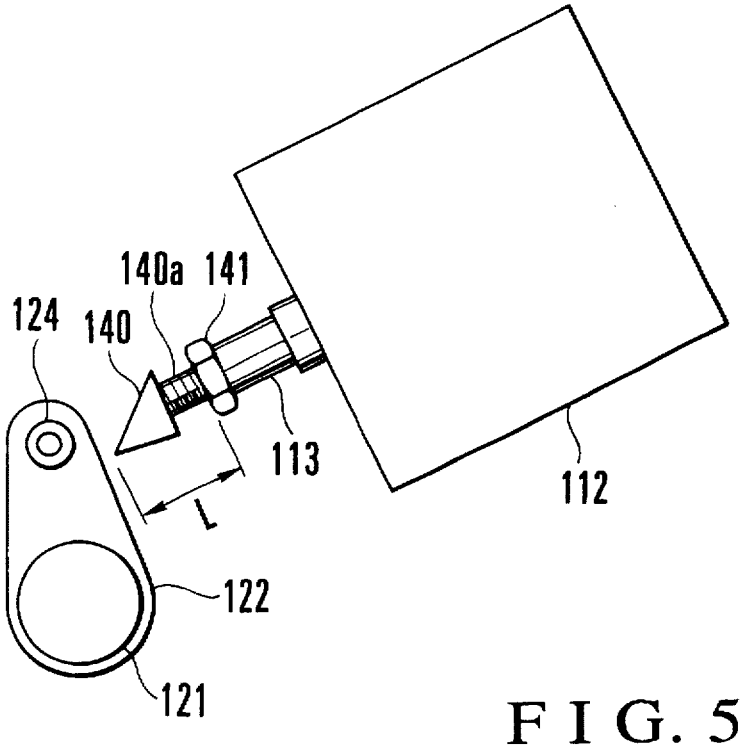
FIG. 5 is a side view of the main part of a cylinder cleaning apparatus for a printing press according to the second embodiment of the present invention.

FIG. 5 shows the main part of a cylinder cleaning apparatus according to the second embodiment of the present invention. Referring to FIG. 5, in place of the plate 135 and the bolts 136 of the first embodiment shown in FIGS. 1 and 2, the cylinder cleaning apparatus has a cloth take-up amount changing actuator 112, an actuating segment 140, and a nut 141. The actuator 112 has an actuating rod 113 attached to substantially the central portion of the sub-frame. The actuating segment 140 has a screw portion 140*a* threadably engaging with the distal end portion of the actuating rod 113. The nut 141 fixes the threadably engaging screw portion 140*a*. Other arrangements are identical to those shown in FIGS. 1 and 2.

In this arrangement, to take up the cleaning cloth, an actuator 104 is actuated to swing the cleaning unit from the cleaning position to the retreat position, and thereafter an actuating rod 105 is moved backward to swing the cleaning unit to the cleaning position, in the same manner as in the first embodiment. As the cleaning unit swings, the actuating segment 140 of the actuating rod 113 abuts against a pin 124 to pivot a cloth take-up lever 122, thereby taking up the cleaning cloth.

To reduce the take-up amount of the cleaning cloth, the actuator 112 is set in the inactive state to move the actuating rod 113 backward. To increase the take-up amount of the cleaning cloth, the actuator 112 is set in the active state to move the actuating rod 113 backward. To increase the take-up amount of the cleaning cloth, the actuator 112 is set in the active state to move the actuating rod 113 forward. When the position of the actuating rod 113 with respect to the pin 124 changes, the distance between the actuating segment 140 of the actuating rod 113 and the pin 124 changes, thereby changing the pivot amount of the cloth take-up lever 122, i.e., the take-up amount of the cleaning cloth. Furthermore, according to this embodiment, when the nut 141 is loosened to change the amount of threadable engagement between the distal end portion of the actuating rod 113 and the screw portion 140*a*, the pivot amount of the cloth take-up lever 122 can be finely adjusted. More specifically, when a projecting amount L of the actuating segment 140 is changed to freely change the distance to the pin 124, the pivot amount of the cloth take-up lever 122 of the actuating rod 113, i.e., the take-up amount of the cleaning cloth can be finely adjusted.

In this second embodiment, in taking up the cleaning cloth, the cleaning unit loaded with the cleaning cloth take-up roll 121 is moved from the retreat position to the cleaning position, in the same manner as in the first embodiment. However, while the cleaning unit is stopped at the retreat position, the actuator 112 may be actuated to move the actuating rod 113 forward/backward, thereby pivoting the cloth take-up lever 122, in the same manner as in the conventional cylinder cleaning apparatus.

Figure 6:
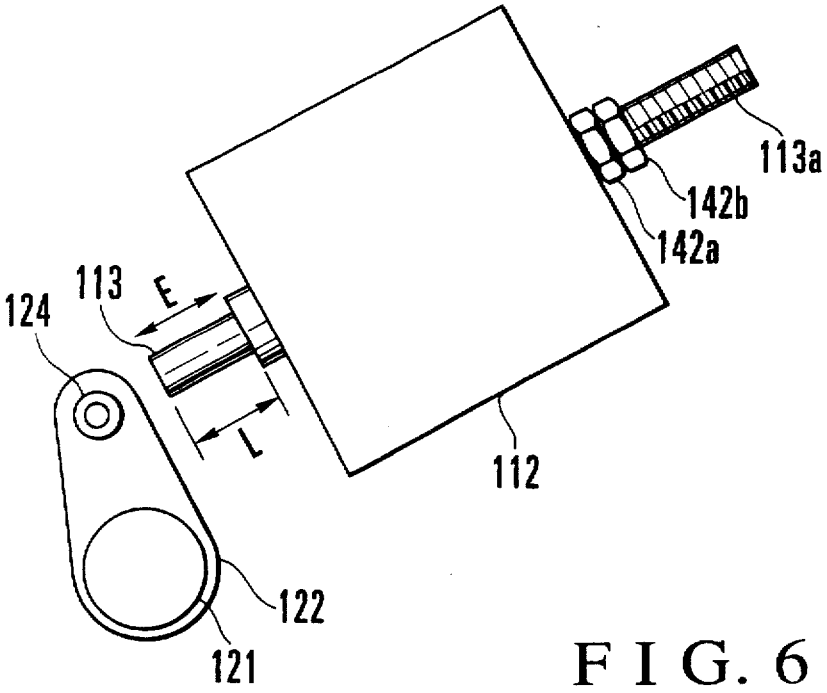
FIG. 6 is a side view of the main part of a cylinder cleaning apparatus for a printing press according to the third embodiment of the present invention.

FIG. 6 shows the main part of a cylinder cleaning apparatus according to the third embodiment of the present invention. In the third embodiment, in place of the actuating segment 140, the screw portion 140*a*, and the nut 141 shown in the second embodiment, the rear end portion of an actuating rod 113 projects from the main body of a cleaning cloth take-up amount adjusting actuator 112, and a screw portion 113*a* is formed on the projecting portion of the actuator 112. Nuts 142*a* and 142*b* constituting a double-nut unit threadably engage with the screw portion 113*a* to set a projecting amount L of the actuating rod 113. Other arrangements are identical to those shown in FIGS. 1 and 2.

In this arrangement, to change the take-up amount of the cleaning cloth taken up upon pivoting a cloth take-up lever 122, the nuts 142*b* and 142*a* are sequentially loosened to change their threadable engagement amount with the screw portion 113*a*, so that the actuating rod 113 is moved in the direction indicated by a double-headed arrow E. Thus, the projecting amount L of the actuating rod 113 is changed to adjust the distal end of the actuating rod 113 away from or close to a pin 124 of the cloth take-up lever 122.

Figure 7A:
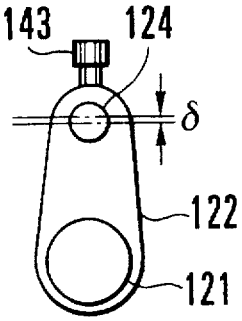
FIG. 7A is a front view of the main part of a cylinder cleaning apparatus for a printing press according to the fourth embodiment of the present invention.
Figure 7B:
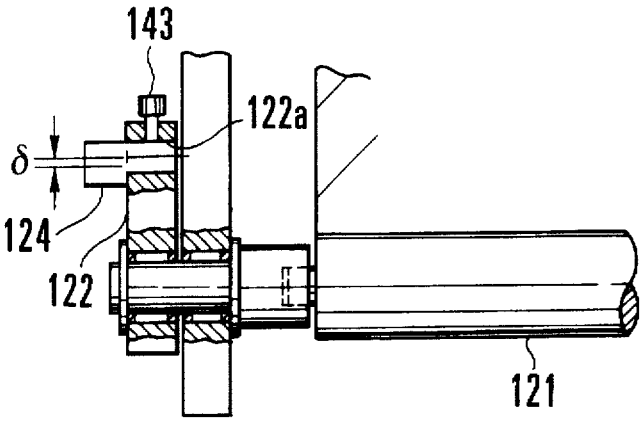
FIG. 7B is a partially sectional side view of the same.

FIGS. 7A and 7B show the main part of a cylinder cleaning apparatus according to the fourth embodiment of the present invention. The fourth embodiment has an actuator 112, in the same manner as in the second and third embodiments shown in FIGS. 5 and 6. However, the cloth take-up amount is not adjusted by the actuator 112 but by a pin 124 of a cloth take-up lever 122. More specifically, the pin 124 is supported in a bearing hole 122*a* of the cloth take-up lever 122 with an eccentricity corresponding to a distance δ. When a bolt 143 is tightened, the pin 124 is prevented from rotating in the bearing hole 122*a* and fixed to the cloth take-up lever 122. Other arrangements are identical to those shown in FIGS. 1 and 2.

In this arrangement, to change the take-up amount of the cleaning cloth taken up upon pivoting the cloth take-up lever 122, the bolt 143 is loosened and the pin 124 is pivoted, so that the distance between an actuating rod 113 of the actuator 112 and the circumferential surface of the pin 124 is adjusted. When adjustment is completed, the bolt 143 is tightened.

In the fourth embodiment, to take up the cleaning cloth, a cleaning unit loaded with a cleaning cloth take-up roll 121 is moved from the retreat position to the cleaning position, in the same manner as in the first embodiment. Alternatively, while the cleaning unit is stopped at the retreat position, the actuator 112 may be actuated to move the actuating rod 113 forward/backward, thereby taking up the cleaning cloth, in the same manner as in the conventional cylinder cleaning apparatus.

Figure 8:
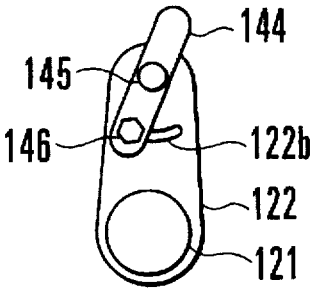
FIG. 8 is a front view of the main part of a cylinder cleaning apparatus for a printing press according to the fifth embodiment of the present invention.

FIG. 8 shows the main part of a cylinder cleaning apparatus according to the fifth embodiment of the present invention. In the fifth embodiment, the cloth take-up amount is adjusted by a cloth take-up lever 122, in the same manner as in the fourth embodiment shown in FIG. 7. Referring to FIG. 8, an auxiliary lever 144 is coupled to the cloth take-up lever 122. The central portion of the auxiliary lever 144 is pivotally supported by a pin 145 extending from the upper end portion of the cloth take-up lever 122, and a screw 146 extends through the lower end portion of the auxiliary lever 144. An arcuated guide groove 122*b* is formed in the cloth take-up lever 122 about the pin 145 as the center. The screw 146 is inserted in the guide groove 122*b*. A nut (not shown) threadably engages with the screw 146. Other arrangements are identical to those shown in FIGS. 1 and 2.

In this arrangement, to change the take-up amount of the cleaning cloth taken up upon pivoting the cloth take-up lever 122, the nut of the screw 146 is loosened, and the auxiliary lever 144 is pivoted along the guide groove 122*b* about the pin 145 as the center of pivot. This adjusts the distance between the upper end portion of the auxiliary lever 144 and an actuating rod 113 of an actuator 112, thereby changing the take-up amount of the cleaning cloth. When adjustment is completed, the nut is tightened on the screw 146.

In the fifth embodiment, to take up the cleaning cloth, a cleaning unit loaded with a cleaning cloth take-up roll 121 is moved from the retreat position to the cleaning position, in the same manner as in the first embodiment. However, while the cleaning unit is stopped at the retreat position, the actuator 112 may be actuated to move the actuating rod 113 forward/backward, thereby taking up the cleaning cloth, in the same manner as in the conventional cylinder cleaning apparatus.

Figure 9:
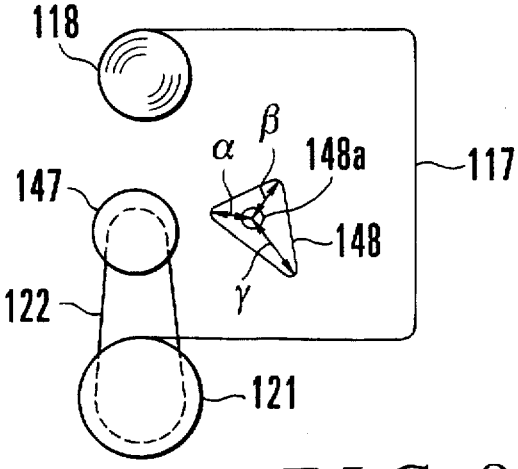
FIG. 9 schematically shows the arrangement of a cylinder cleaning apparatus for a printing press according to the sixth embodiment of the present invention.

FIG. 9 schematically shows a cylinder cleaning apparatus according to the sixth embodiment of the present invention. The sixth embodiment is a modification of the second embodiment shown in FIG. 5. Referring to FIG. 9, a roller 147 is pivotally mounted on the upper end portion of a cloth take-up lever 122. An adjusting cam 148 is attached to the distal end of an actuating rod 113 of an actuator 112. The cam 148 is formed into such a triangle that distances α, β, and Y between its rotation center 148*a* and its respective vertices differ ($\alpha \neq \beta \neq Y$), and is supported such that its pivot angle can be selected by a click mechanism (not shown) so that the respective vertices are selectively brought into contact with the roller 147. Other arrangements are identical to those shown in FIGS. 1 and 2.

In this arrangement, to change the take-up amount of the cleaning cloth taken up upon pivoting a cloth take-up lever 122, the actuating cam 148 is pivoted to select which vertex is to come into contact with the roller 147. In the fifth embodiment, to take up the cleaning cloth, a cleaning unit loaded with a cleaning cloth take-up roll 121 is moved from the retreat position to the cleaning position, in the same manner as in the first embodiment.

Figure 10A:
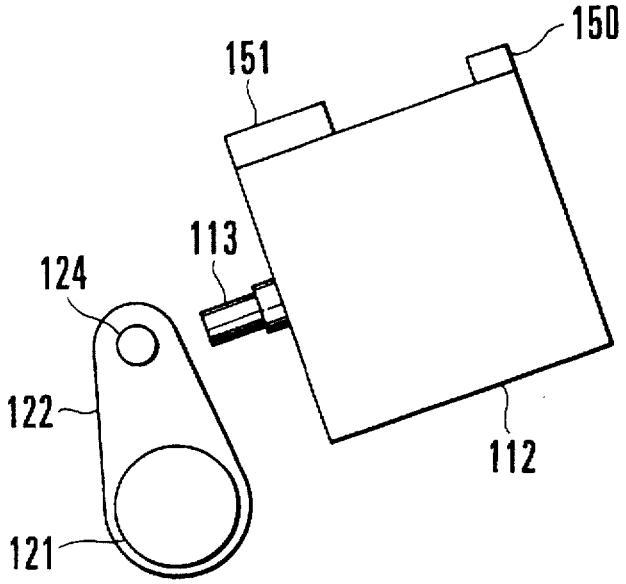
FIG. 10A is a schematic side view of a cylinder cleaning apparatus for a printing press according to the seventh embodiment of the present invention.
Figure 10B:
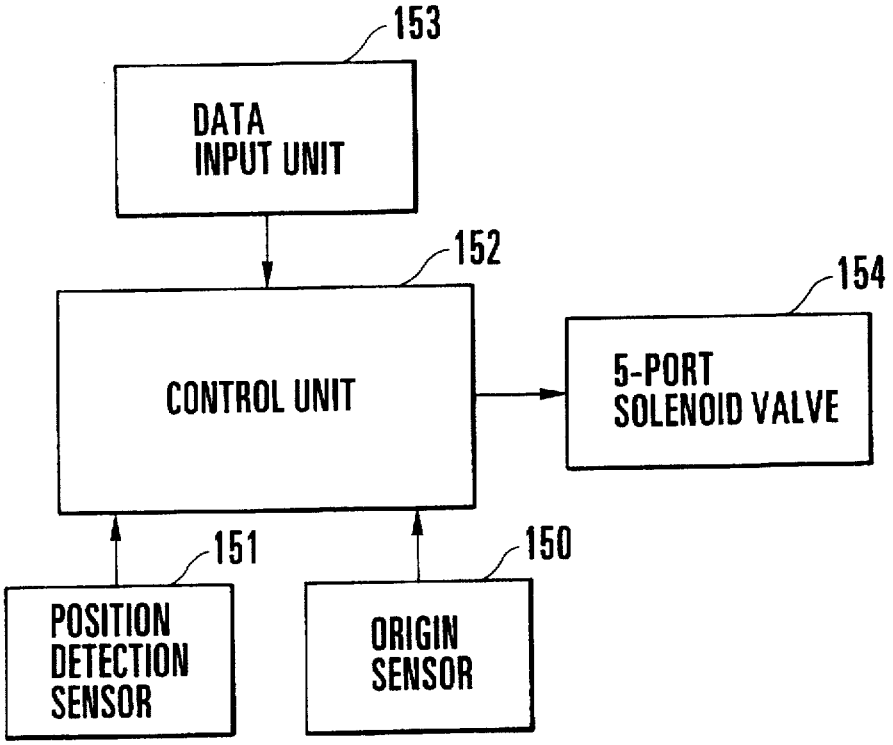
FIG. 10B is a block diagram of the same.

FIGS. 10A and 10B show the schematic arrangement of a cylinder cleaning apparatus according to the seventh embodiment of the present invention. Referring to FIGS. 10A and 10B, an origin sensor 150 detects the origin position of an actuating rod 113 obtained when the actuating rod 113 moves into an actuator 112 the most backward. A position detection sensor 151 detects the amount of forward movement for which the actuating rod 113 has moved forward from the position detected by the origin sensor 150. A control unit 152 controls the respective mechanisms of the printing press. A data input unit 153 inputs data on the take-up amount of the cleaning cloth to the control unit 152. A 5-port solenoid valve 154 actuates the actuator 112 to move the actuating rod 113 forward/backward with five levels of forward/backward moving amount. Other arrangements are identical to those shown in FIGS. 1 and 2.

How to adjust the take-up amount of the cleaning cloth in this cylinder cleaning apparatus will be described. First, the control unit 152 detects with the origin sensor 150 that the actuating rod 113 is located at the origin position, and inputs the origin position data of the actuating rod 113. Data on the take-up amount of the cleaning cloth is input from the data input unit 153 to the control unit 152. The control unit 152 calculates the forward moving amount (projecting amount) of the actuating rod 113 from the origin position data and cleaning cloth take-up amount data and actuates the 5-port solenoid valve 154 in the forward moving direction of the actuating rod 113. When the actuating rod 113 is moved forward by the 5-port solenoid valve 154, the control unit 152 causes the position detection sensor 151 to detect the actual forward moving amount of the actuating rod 113, and stops actuation of the 5-port solenoid valve 154 when the detected forward moving amount coincides with the calculated one. The position detection sensor 151 may be omitted and the 5-port solenoid valve 154 may be controlled by an amount corresponding to the calculated forward moving amount of the actuating rod 113.

In this embodiment, the projecting position of the actuating rod 113 with respect to a pin 124 of a cloth take-up lever 122 is automatically adjusted by the cleaning cloth take-up amount data. Therefore, the take-up amount of the cleaning cloth upon pivoting the cloth take-up lever 122 when the cleaning unit swings can be adjusted accurately and quickly.

Figure 11:
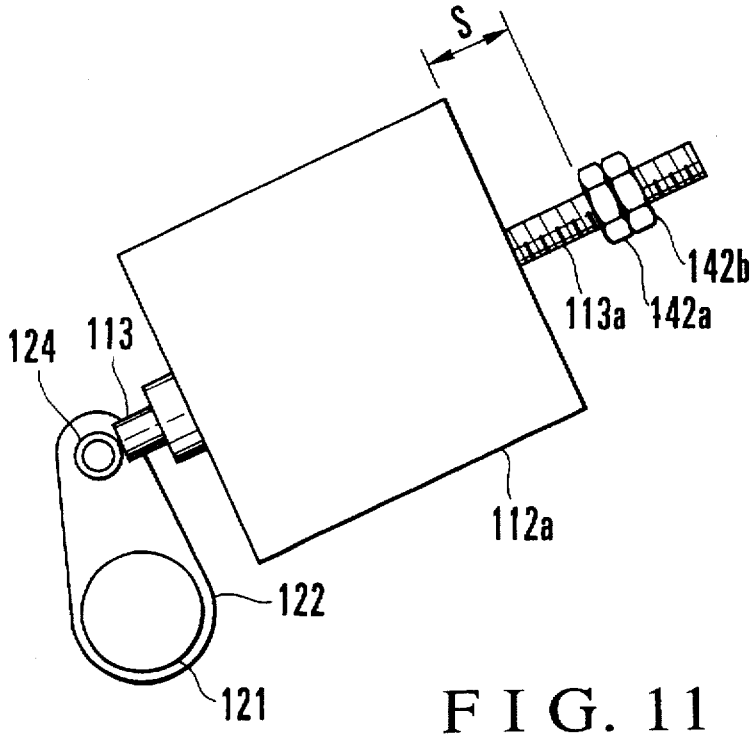
FIG. 11 is a schematic side view of a cylinder cleaning apparatus for a printing press according to the eighth embodiment of the present invention.

FIG. 11 shows the schematic arrangement of a cylinder cleaning apparatus according to the eighth embodiment of the present invention. The eighth embodiment has a similar arrangement to that of the third embodiment shown in FIG. 6 and is different from the arrangement of FIG. 6 in the following respects. In taking up the cleaning cloth, an actuator 112*a* for taking up the cloth is actuated not by swinging the cleaning unit from the retreat position to the cleaning position but while the cleaning unit is stopped at the cleaning position or the retreat position, so that an actuating rod 113 pivots a cloth take-up lever 122 through a pin 124. Other arrangements are identical to those shown in FIGS. 1 and 2.

In this arrangement, nuts 142*a* and 142*b* are sequentially loosened to form a distance S between the nut 142*a* and the rear end face of the actuator 112*a*. In this state, when the actuator 112*a* is actuated to move the actuating rod 113 forward, the actuating rod 113 moves forward for a stroke S until the nut 142*a* is locked by the rear end face of the actuator 112*a*, to pivot the cloth take-up lever 122 counterclockwise in FIG. 11, thereby taking up the cleaning cloth on a cleaning cloth take-up roll 121. To change the take-up amount of the cleaning cloth, the nuts 142*a* and 142*b* are loosened to change the distance S, thereby changing the forward moving amount of the actuating rod 113.

The actuator 112*a* may be mounted on the cleaning unit mounted with the cloth take-up lever 122. In this case, the relative positional relationship between the actuator 112*a* and the cloth take-up lever 122 is always constant regardless of the swing position of the cleaning unit.

Figure 12:
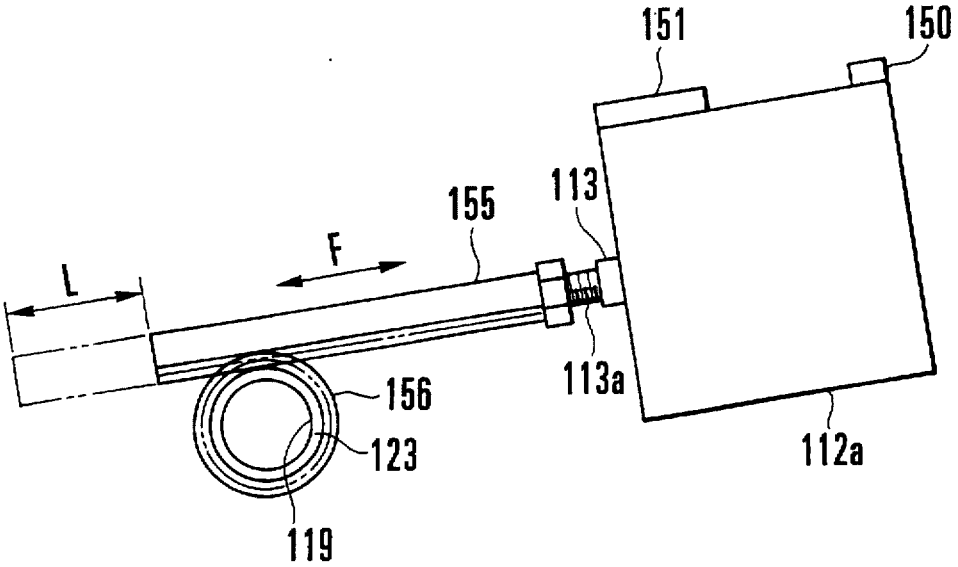
FIG. 12 is a schematic side view of a cylinder cleaning apparatus for a printing press according to the ninth embodiment of the present invention.

FIG. 12 shows the schematic arrangement of a cylinder cleaning apparatus according to the ninth embodiment of the present invention. Referring to FIG. 12, a screw portion 113*a* is formed on the distal end portion of an actuating rod 113. A rack 155 threadably engages with the screw portion 113*a*. The rack 155 is attached to the actuating rod 113 through a nut 155*a*. A pinion 156 is coaxially coupled to a cloth take-up shaft 119 through a one-way clutch 123 and meshes with the rack 155. In this embodiment, a cloth take-up actuator 112*a* is mounted on a cleaning unit mounted with the cloth take-up shaft 119. Other arrangements are identical to those shown in FIGS. 1 and 2.

In this arrangement, the cleaning cloth take-up operation will be described. The cloth take-up actuator 112*a* is actuated to move the actuating rod 113 forward/backward. The origin position of the actuating rod 113 is detected by an origin sensor 150 based on the preset cleaning cloth take-up amount data. The moving amount of the actuating rod 113 is detected by a position detection sensor 151, the actuating rod 113 is stopped, and a forward/backward moving amount L of the actuating rod 113 is determined. Upon forward/backward movement of the actuating rod 113, the rack 155 reciprocates in the directions of a double-headed arrow F in FIG. 12, so that the pinion 156 meshing with the rack 155 rotates clockwise/counterclockwise. When the pinion 156 rotates counterclockwise, the cloth take-up shaft 119 rotates together with the pinion 156 through the one-way clutch 123 to take up the cleaning cloth on the cloth take-up roll. The take-up amount of the cleaning cloth at this time is equal to a moving amount L of the rack 155, i.e., the forward/backward moving amount of the actuating rod 113. When the pinion 156 rotates clockwise, the rotation is not transmitted through the one-way clutch 123, and the cloth take-up shaft 119 is not rotated but is stopped. To change the take-up amount of the cleaning cloth, the cleaning cloth take-up amount data is changed, the position detection sensor 151 detects the changed moving amount of the actuating rod 113 based on the altered data, and the actuating rod 113 is stopped, so that the moving amount L is changed.

Figure 13:
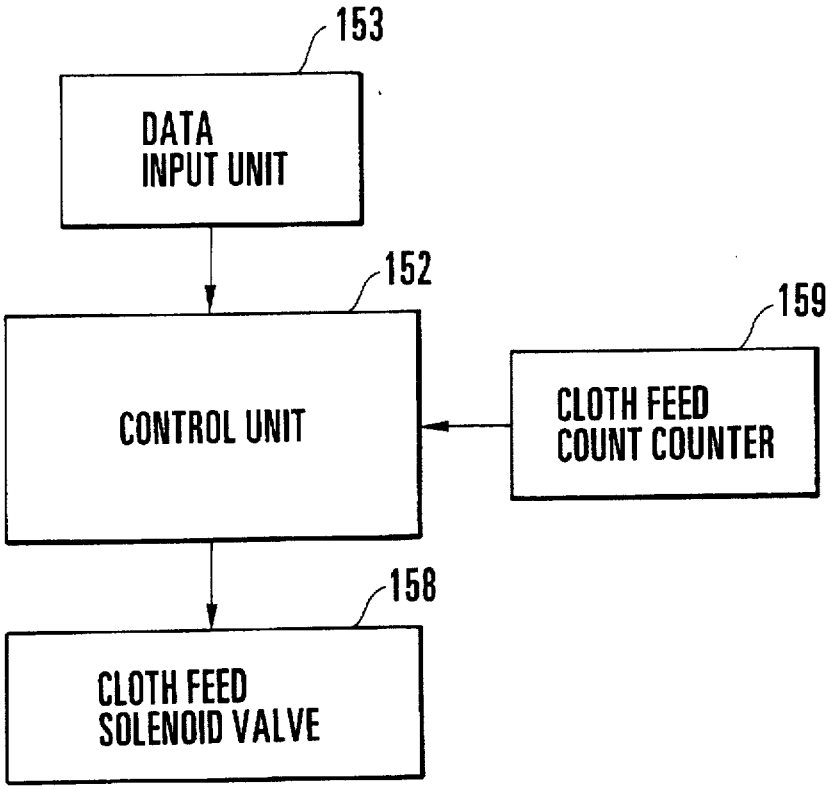
FIG. 13 is a block diagram of a cylinder cleaning apparatus for a printing press according to the 10th embodiment of the present invention.

FIG. 13 shows a cylinder cleaning apparatus according to the 10th embodiment of the present invention. Referring to FIG. 13, a cloth feed solenoid valve 158 actuates a cloth take-up actuator. A cloth feed count counter 159 counts the actuation count of the cloth take-up actuator as shown in FIG. 11. Other arrangements are identical to those shown in FIGS. 1 and 2. In this arrangement, when the cleaning cloth take-up amount data is input from a data input unit 153, a control unit 152 sets the actuation count of the cloth take-up actuator based on the input data, and sends a control signal to the cloth feed solenoid valve 158. The cloth feed count counter 159 counts the number of times of actuation of the cloth feed solenoid valve 158, and the control unit 152 actuates the cloth feed solenoid valve 158 until the cloth feed count counter 159 reaches a preset count. Every time the cloth feed solenoid valve 158 actuates, the cloth take-up actuator repeats taking up the cleaning cloth, thereby taking up a predetermined amount of cleaning cloth.

To change the take-up amount of the cleaning cloth, changed data is input from the data input unit 153 to the control unit 152, so that a control signal representing a changed actuation count is sent from the control unit 152 to the cloth feed solenoid valve 158.

Figure 14A:
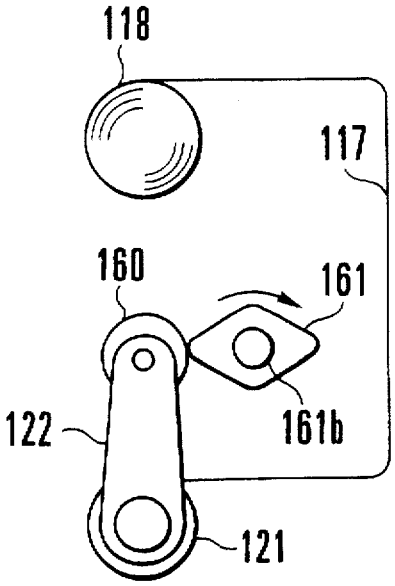
FIG. 14A is a front view of the main part of a cylinder cleaning apparatus for a printing press according to the 11th embodiment of the present invention.
Figure 14B:
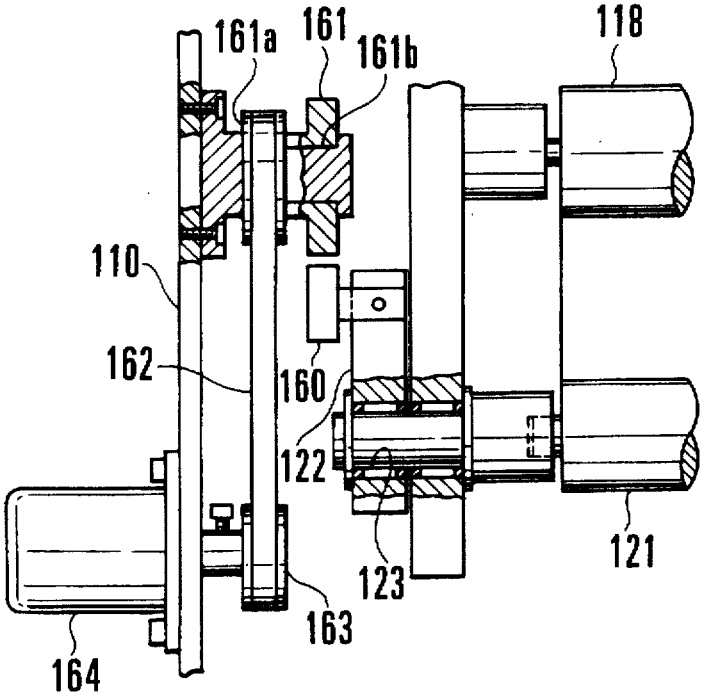
FIG. 14B is a partially sectional side view of the same.

FIGS. 14A and 14B show the main part of a cylinder cleaning apparatus according to the 11th embodiment of the present invention. Referring to FIGS. 14A and 14B, a roller 160 is pivotally mounted on the distal end of a cloth take-up lever 122. A rhombic driving cam 161 is integrally formed with a pulley 161*a*. The roller 160 comes into contact with the driving cam 161. The driving cam 161 is rotatably supported by a support shaft 161*b* extending from a sub-frame 110. The cloth take-up lever 122 is biased by a spring member (not shown) clockwise in FIG. 14A, i.e., such that the roller 160 comes into contact with the driving cam 161. A belt 162 extends between the pulley 161*a* and a pulley 163 axially mounted on the motor shaft of a motor 164. Other arrangements are identical to those shown in FIGS. 1 and 2.

In this arrangement, when the motor 164 is driven, its rotation is transmitted to the pulley 161*a* through the pulley 163 and the belt 162 to rotate the driving cam 161. When the driving cam 161 rotates, the cloth take-up lever 122 swings a plurality of counts clockwise/counterclockwise through the roller 160 which is in contact with the driving cam 161, to rotate a cleaning cloth take-up roll 121 coupled to the cloth take-up lever 122 through a one-way clutch 123 counterclockwise, thereby taking up a cleaning cloth 117. To change the take-up amount of the cleaning cloth 117, the preset rotation speed of the motor 164 is changed to change the rotation count of the driving cam 161, thereby changing the clockwise/counterclockwise swing count of the cloth take-up lever 122.

Figure 15A:
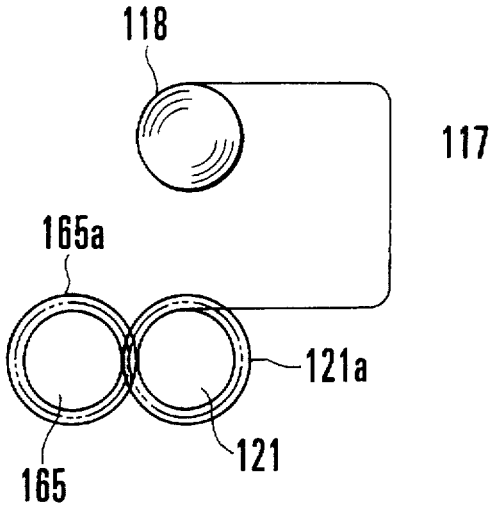
FIG. 15A is a front view of the main part of a cylinder cleaning apparatus for a printing press according to the 12th embodiment of the present invention.
Figure 15B:
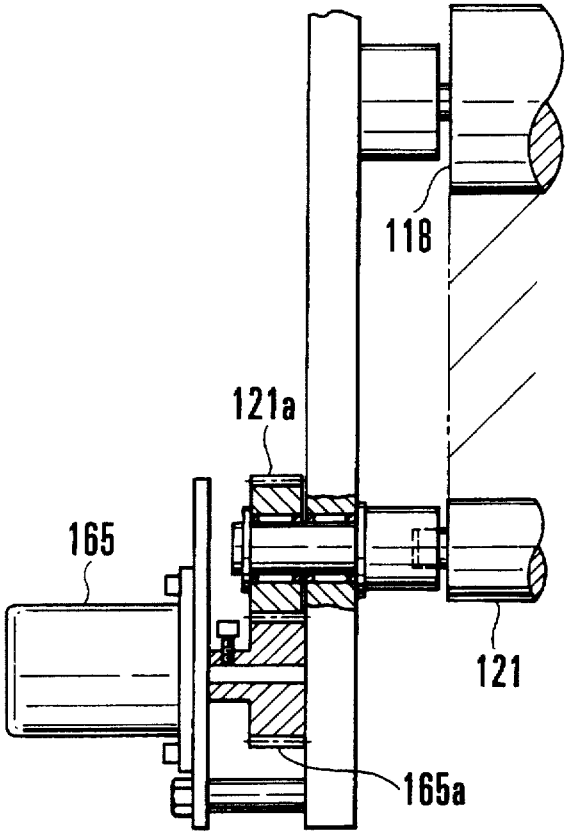
FIG. 15B is a partially sectional side view of the same.
Figure 15C:
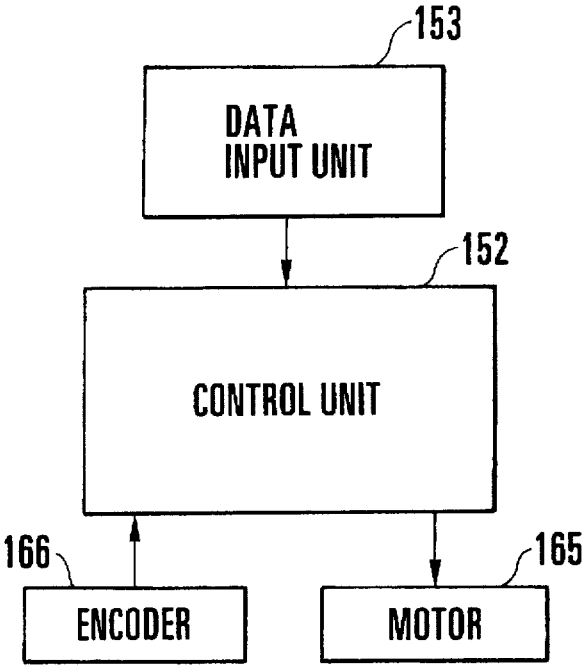
FIG. 15C is a block diagram of the same.

FIGS. 15A, 15B, and 15C show a cylinder cleaning apparatus according to the 12th embodiment of the present invention. Referring to FIGS. 15A, 15B, and 15C, a motor 165 incorporates an encoder 166. A gear 165*a* meshing with a gear 121*a* integrally formed on the side surface of a cleaning cloth take-up roll 121 is axially mounted on the motor shaft of the motor 165. Other arrangements are identical to those shown in FIGS. 1 and 2. In this arrangement, a control unit 152 sets the rotation speed of the motor 165 based on the cleaning cloth take-up amount data input from a data input unit 153, and sends a control signal to drive the motor 165. Rotation of the motor 165 is transmitted to the cleaning cloth take-up roll 121 through the gears 165*a* and 121*a* to take up a cleaning cloth 117. The rotation speed of the motor 165 is input from the encoder 166 to the control unit 152. When the control unit 152 detects coincidence between the rotation speed of the motor 165 sent from the encoder 166 and the preset rotation speed, it controls the motor 165 to stop driving. To change the take-up amount of the cleaning cloth 117, the data on the take-up amount of the cleaning cloth 117 which is sent from the data input unit 153 is changed.

Figure 16:
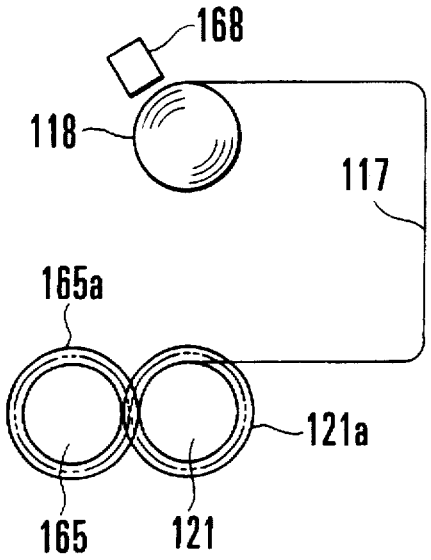
FIG. 16 is a schematic side view of a cylinder cleaning apparatus for a printing press according to the 13th embodiment of the present invention.

FIG. 16 shows a cylinder cleaning apparatus according to the 13th embodiment of the present invention. Referring to FIG. 16, a shift sensor 168 is arranged close to a cleaning cloth supply roll 118 to replace the encoder 166 shown in FIG. 15, and detects the diameter of the cleaning cloth supply roll 118. Other arrangements are identical to those shown in FIGS. 1 and 2. In this arrangement, upon rotation of a motor 165, a cleaning cloth take-up roll 121 rotates to take up a cleaning cloth 117 on it, so that the diameter of the cleaning cloth supply roll 118 is gradually decreased. A control unit 152 converts the change in diameter of the cleaning cloth supply roll 118 detected by the shift sensor 168 into the take-up amount of the cleaning cloth 117. When the control unit 152 detects coincidence between the take-up amount obtained by conversion and the preset take-up amount of the cleaning cloth, it stops the motor 165 to stop taking up the cleaning cloth. To change the take-up amount of the cleaning cloth 117, the preset take-up amount of the cleaning cloth 117 as the input data is changed.

Figure 17:
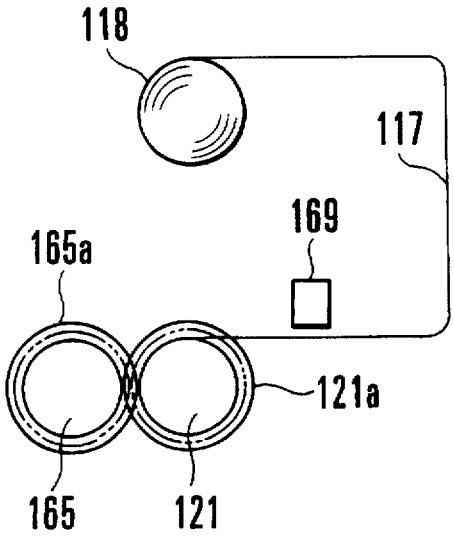
FIG. 17 is a schematic side view of a cylinder cleaning apparatus for a printing press according to the 14th embodiment of the present invention.
Figure 18:
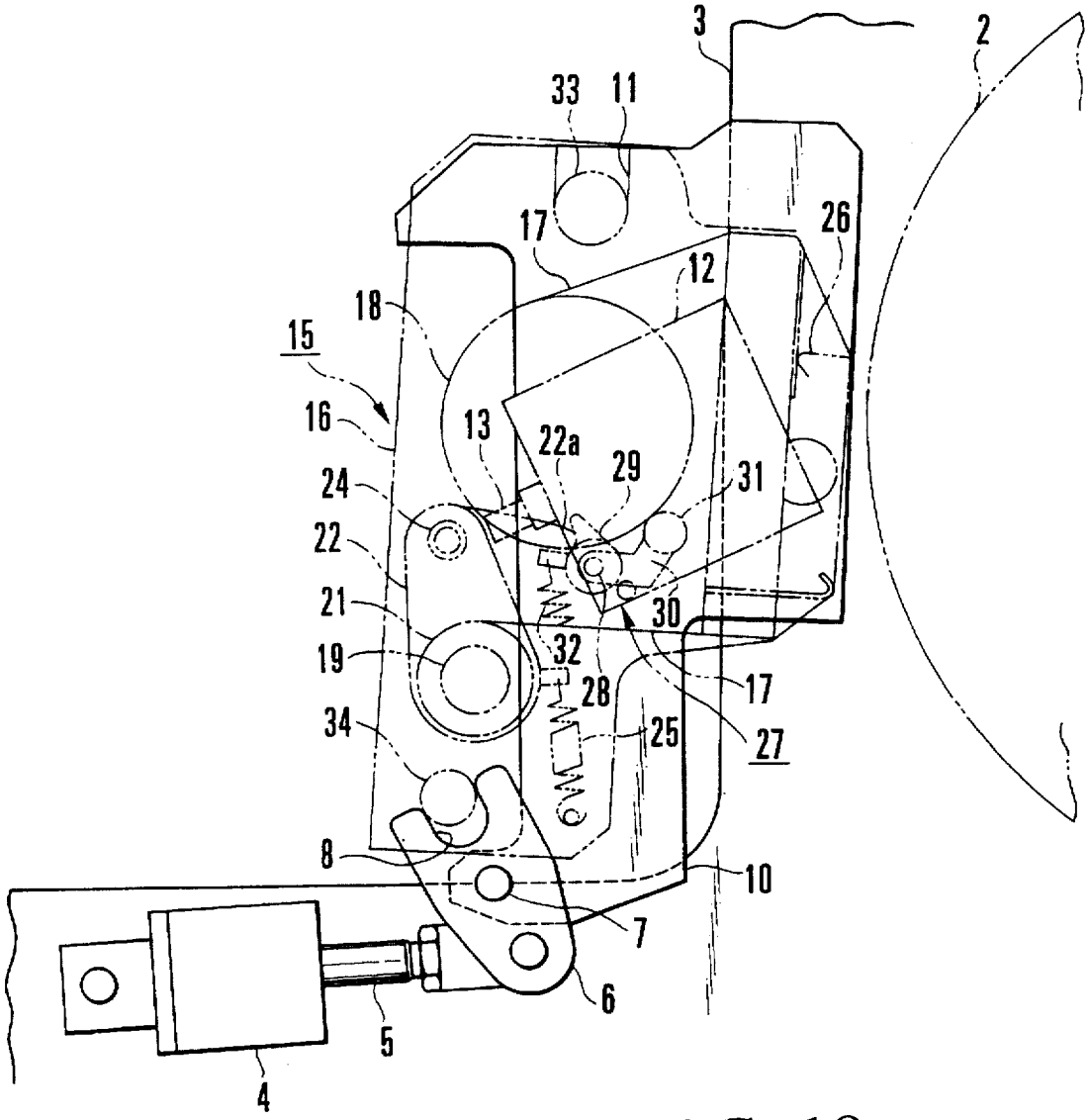
FIG. 18 PRIOR ART
FIG. 18 is a side view of a conventional cylinder cleaning apparatus for a printing press.
Figure 19:
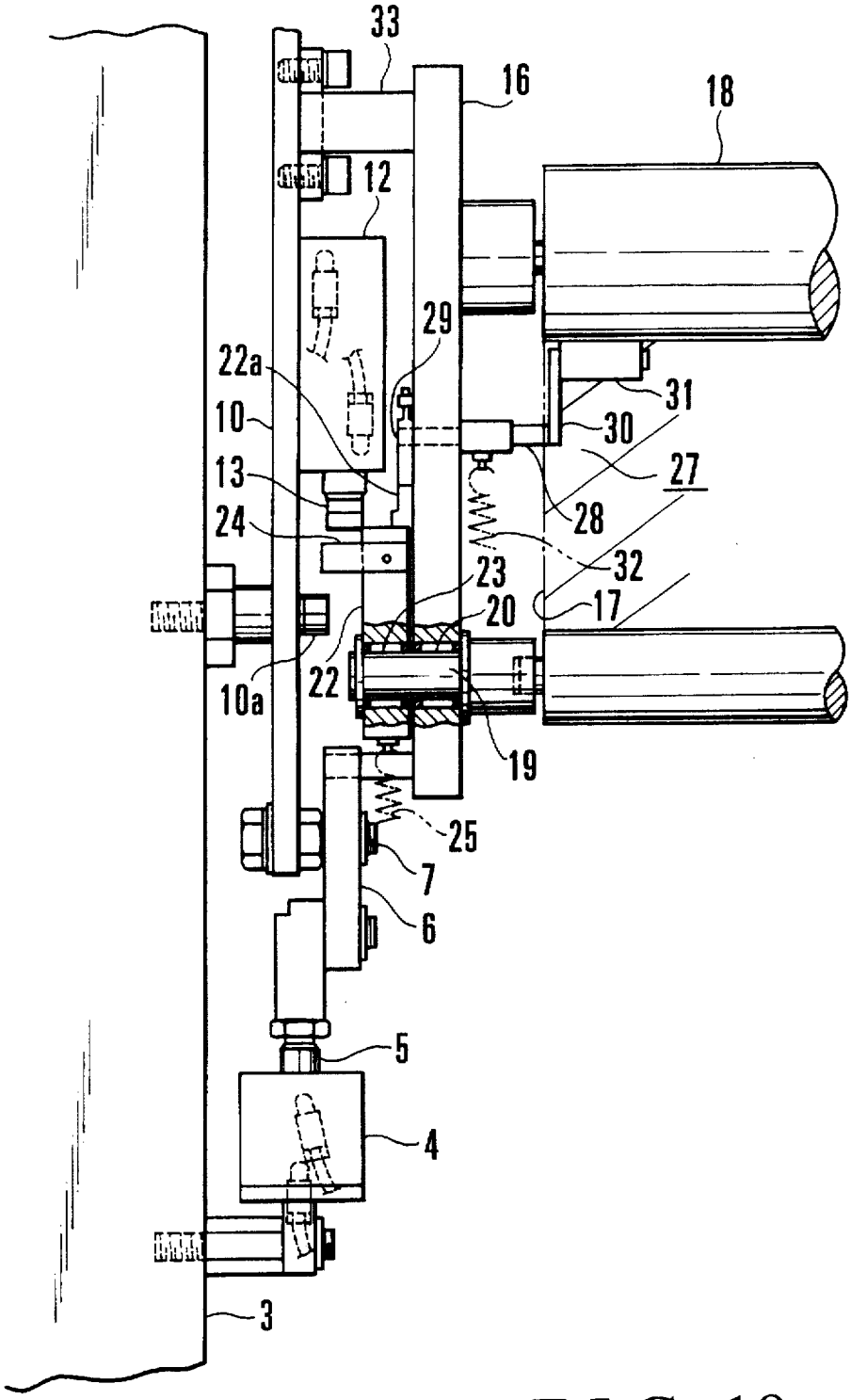
FIG. 19 PRIOR ART
FIG. 19 is a partially sectional front view of the conventional cylinder cleaning apparatus for a printing press.

FIG. 17 shows a cylinder cleaning apparatus according to the 14th embodiment of the present invention. Referring to FIG. 17, a feed amount measurement sensor 169 is arranged close to a cleaning cloth 117 to replace the encoder 166 shown in FIG. 15, and measures the moving amount of the cleaning cloth 117. Other arrangements are identical to those shown in FIGS. 1 and 2. In this arrangement, upon rotation of a motor 165, a cleaning cloth take-up roll 121 rotates to take up the cleaning cloth 117 on it. The take-up amount of the cleaning cloth 117 is detected by measuring the moving amount of the cleaning cloth 117 with the feed amount measurement sensor 169. When a control unit 152 detects coincidence between the measured moving amount of the cleaning cloth 117 and the preset take-up amount of the cleaning cloth, it stops the motor 165 to stop taking up the cleaning cloth. To change the take-up amount of the cleaning cloth 117, the preset take-up amount of the cleaning cloth 117 as the input data is changed.

In the embodiments described above, a blanket cylinder is taken as an example of cylinders to be cleaned. However, the present invention is not limited to this, but can naturally be applied to any cylinders, e.g., printing cylinders such as a plate cylinder and a transfer cylinder, and rollers such as a form roller and a vibrating roller, that need cleaning.

In the above embodiments, when cleaning the cylinder, the cleaning liquid is sprayed to the cleaning web. However, the cleaning liquid may be sprayed to the circumferential surface of the cylinder and be wiped with a cleaning web, or the circumferential surface of the cylinder may be wiped with a cleaning web wetted with the cleaning liquid in advance, while achieving the same operation and effect as those described above. Although a cloth is used as the cleaning web, the present invention is not limited to this, and the cleaning web can be paper, a film, or the like, as a matter of course.

As a cleaning cloth supply portion, a cleaning cloth take-up roll is employed. However, a supply portion in which a folded cleaning cloth is accommodated in a stacking manner may be employed. Various other changes and modifications in design can be made.

As has been described above, according to the present invention, in taking up a constant amount of cleaning cloth on a take-up roll with a constant amount feed mechanism, the distance between the actuation target member of the take-up lever and the actuating member is adjusted to adjust the take-up amount of the cleaning web. Therefore, a short in take-up amount of soiled cleaning web, which leads to defective cleaning, can be prevented. The cleaning web will not be taken up more than necessary, thus providing an economical advantage.

The distance between the actuating member attached to the printing press frame and the actuation target member of the cloth take-up lever provided to the cleaning unit is adjusted, and the cleaning unit provided with the take-up lever is moved from the retreat position, where the cleaning web is separate from the circumferential surface of the cylinder, to the cleaning position, where the cleaning web is in contact with the circumferential surface of the cylinder, to take up the cleaning cloth. Therefore, the cylinder cleaning apparatus of the present invention can be realized at a low cost without changing the conventional structure.

The cleaning cloth take-up amount data is input to automatically set the distance between the actuation target member of the take-up lever and the actuating member and the actuation count and actuation stroke of the cloth take-up actuator. Therefore, the take-up amount can be adjusted easily and accurately, and the adjusting operation is facilitated, thereby shortening the time required for adjustment.

What is claimed is:

1. An apparatus for cleaning a printing press cylinder using a cleaning web, comprising:

take-up roll for taking up the cleaning web to clean a circumferential surface of the cylinder;

a constant amount feed mechanism for causing a constant amount of the cleaning web to be taken up on said take-up roll regardless of an amount of taken cleaning web on said take-up roll;

driving means for driving to rotate said take-up roll in taking up the cleaning web including a take-up lever for transmitting a pivot force to said take-up roll in only a take-up direction of the cleaning web, the take-up lever being biased in a counter take-up direction of the cleaning web, said take-up lever having an actuation target member; and adjusting means for adjusting a pivot amount of said take-up roll to cause a change in the constant amount of the cleaning web being taken-up on said take-up roll.

2. An apparatus according to claim 1, wherein said driving means further comprises an actuating member for engaging with the actuation target member of said take-up lever to pivot said take-up roll, and moving means for moving one of said take-up lever and said actuating member in taking up the cleaning web to actuate said actuating member with respect to said take-up lever, and said adjusting means comprises distance adjusting means for adjusting an initial distance between the actuation target member of said take-up lever and said actuating member.

3. An apparatus according to claim 2, further comprising a cleaning unit including said take-up roll, said take-up lever, and said constant amount feed mechanism, and supported by a printing press frame to be movable between a cleaning position to cause the cleaning web to come into contact with said circumferential surface of said cylinder and a retreat position to separate the cleaning web from said circumferential surface of said cylinder, and wherein said moving means moves said cleaning unit from the retreat position to the cleaning position in taking up the cleaning web to actuate said actuating member with respect to said take-up lever, thereby pivoting said take-up roll.

4. An apparatus according to claim 2, wherein said moving means moves said actuating member forward/backward in taking up the cleaning web to actuate said actuating member with respect to said take-up lever.

5. An apparatus according to claim 4, wherein said moving means comprises an actuator for driving said actuating member to move forward/backward, and said adjusting means comprises an adjusting member for physically adjusting a forward moving amount of said actuating member in taking up the cleaning web.

6. An apparatus according to claim 2, wherein said distance adjusting means moves said actuating member toward and away from said actuation target member of said take-up lever to perform initial setting of a distance between said actuating member and said actuation target member.

7. An apparatus according to claim 6, wherein said actuating member comprises an elongated plate, and said distance adjusting means comprises a fixing member for attaching said plate to a printing press frame so as to be adjustable the initial distance between a distal end of said plate and said actuation target member.

8. An apparatus according to claim 6, wherein said distance adjusting means comprises an actuator for actuating said actuating member to move forward/backward and sets an initial distance between said actuating member and said actuation target member in accordance with active/inactive states of said actuator.

9. An apparatus according to claim 8, wherein said actuator comprises an actuator rod, said actuating member comprises an actuating segment attached to a distal end of the actuating rod of said actuator, and said distance adjusting means comprises a forward/backward movable member for moving said actuating segment toward/away from said distal end of said actuating rod of said actuator.

10. An apparatus according to claim 8, wherein said actuator comprises an actuating rod, and said distance adjusting means comprises a forward/backward moving amount adjusting member for physically adjusting a forward/backward moving amount of said actuating rod of said actuator.

11. An apparatus according to claim 6, wherein said distance adjusting means comprises an actuator for actuating said actuating member to move forward/backward, a multi-port solenoid valve for adjusting a forward/backward moving amount of said actuator in a multiple of stages, setting means for setting a take-up amount of the cleaning web, and control means for controlling a forward position of said multi-port solenoid valve based on the take-up amount of the cleaning web set in said setting means.

12. An apparatus according to claim 2, wherein said actuating member comprises a cam member pivotally supported by a printing press frame, and said cam member pivots to adjust a distance to said actuation target member of said take-up lever, thereby constituting said distance adjusting means.

13. An apparatus according to claim 2, wherein said distance adjusting means comprises an adjusting member for moving said actuation target member of said take-up lever toward and away from said actuating member, and a fixing member for fixing said adjusting member on said take-up lever to perform initial setting of the distance between said actuating member and said actuation target member.

14. An apparatus according to claim 2, further comprising a one-way clutch for transmitting a pivot force of said web take-up lever to said take-up roll in only a take-up direction of the cleaning web, and a spring member for biasing said web take-up lever in a counter take-up direction of the cleaning web.

15. An apparatus according to claim 1, wherein said driving means comprises a forward/backward movable member coupled to said take-up roll to move forward/backward, and an actuator for driving said forward/backward movable member to move forward/backward in taking up the cleaning web, thereby pivoting said take-up roll, and said adjusting means adjusts a forward/backward moving amount of said forward/backward movable member.

16. An apparatus according to claim 1, wherein said driving means comprises divisional pivoting means for pivoting said take-up roll in a divisional manner, and said adjusting means comprises setting means for setting a take-up amount of the cleaning web, and control means for controlling said divisional pivoting means to drive based on a take-up amount of the cleaning web set in said setting means.

17. An apparatus according to claim 16, further comprising a take-up lever which transmits a pivot force to said take-up roll in only a take-up direction of the cleaning web and which is biased in a counter take-up direction of the cleaning web, and wherein said divisional pivoting means comprises a motor and a rhombic cam member engaging with said actuation target member of said web take-up lever and driven by said motor to rotate.

18. An apparatus according to claim 1, wherein said adjusting means comprises setting means for setting a take-up amount of the cleaning web, detection means for detecting a take-up amount of the cleaning web in taking up the cleaning web, and control means for controlling said driving means in accordance with the take-up amount of the cleaning web which is set in said setting means and the take-up amount of the cleaning web which is detected by said detection means.

19. An apparatus for cleaning a printing press cylinder using a cleaning web, comprising:

a take-up roll for taking up the cleaning web to clean a circumferential surface of the cylinder;

a constant amount feed mechanism for taking up a constant amount of the cleaning web on said take-up roll regardless of an amount of taken cleaning web on said take-up roll;

a take-up lever for transmitting a pivot force to said take-up roll in only a take-up direction of the cleaning web and being biased in a counter take-up direction of the cleaning web, said take-up lever having an actuation target member;

an actuating member for engaging with the actuation target member of said take-up lever to pivot said take-up roll;

adjusting means for adjusting an initial distance between the actuation target member of said take-up lever and said actuating member;

a cleaning unit including said take-up roll, said take-up lever, and said constant amount feed mechanism, and supported by a printing press frame and being movable between a cleaning position to cause the cleaning web to come into contact with said circumferential surface of said cylinder and a retreat position to separate the cleaning web from said circumferential surface of said cylinder; and an actuator for swinging said cleaning unit from the retreat position to the cleaning position in taking up the cleaning web to actuate said actuating member with respect to said take-up lever, thereby pivoting said take-up roll.

* * * * *